US010184760B2

(12) United States Patent
Bishop et al.

(10) Patent No.: US 10,184,760 B2
(45) Date of Patent: Jan. 22, 2019

(54) TACTICAL DETERRENT DEVICES

(71) Applicant: Durendal LLC, Scottsdale, AZ (US)

(72) Inventors: Lyman Bishop, Laguna Niguel, CA (US); Lonnie Young, Dry Ridge, KY (US); Mike Hilberath, Mission Viejo, CA (US); Paolo M. Vianson, Scottsdale, AZ (US)

(73) Assignee: DURENDAL, LLC, Scottsdale, AZ (US)

( * ) Notice: Subject to any disclaimer, the term of this patent is extended or adjusted under 35 U.S.C. 154(b) by 653 days.

(21) Appl. No.: 14/563,650

(22) Filed: Dec. 8, 2014

(65) Prior Publication Data

US 2016/0231090 A1 Aug. 11, 2016

Related U.S. Application Data

(60) Provisional application No. 61/913,783, filed on Dec. 9, 2013.

(51) Int. Cl.

| | |
|---|---|
| ***F21L 4/00*** | (2006.01) |
| ***F41H 13/00*** | (2006.01) |
| ***F42B 12/42*** | (2006.01) |
| ***F42B 27/00*** | (2006.01) |
| ***F21V 15/04*** | (2006.01) |
| ***H04R 1/02*** | (2006.01) |
| ***H04R 17/00*** | (2006.01) |
| ***H05B 41/34*** | (2006.01) |

(52) U.S. Cl.

CPC ..... *F41H 13/0081* (2013.01); *F21V 15/04* (2013.01); *F41H 13/0087* (2013.01); *F42B 12/42* (2013.01); *F42B 27/00* (2013.01); *H04R 1/028* (2013.01); *H04R 17/00* (2013.01); *H05B 41/34* (2013.01); *H04R 2499/15* (2013.01)

(58) Field of Classification Search

CPC ..... A63B 2071/009; F41H 13/0043; F41H 13/0081; F41H 13/0087; F41H 13/0056; F21V 15/04; F21V 33/0052; F21V 33/0056

See application file for complete search history.

(56) References Cited

U.S. PATENT DOCUMENTS

| | | | | |
|---|---|---|---|---|
| 2,355,247 | A * | 8/1944 | Slocum | F21L 4/00 362/158 |
| 5,511,978 | A | 4/1996 | Sellers, Jr. et al. | |
| 2006/0176686 | A1 * | 8/2006 | McVicker | F21S 9/022 362/183 |
| 2006/0230972 | A1 | 10/2006 | Ouliarin | |

(Continued)

FOREIGN PATENT DOCUMENTS

| | | | |
|---|---|---|---|
| EP | 2053343 | A2 | 4/2009 |

OTHER PUBLICATIONS

PCT International Search Report and Written Opinion in International Application PCT/US2014/069133, dated Aug. 28, 2015, 14 pgs.

*Primary Examiner* — Evan Dzierzynski

(57) ABSTRACT

An apparatus has a lens. A frame has a gasket for receiving the lens and a shock-resistant housing is secured about the frame. A visual output element is disposed proximate the lens and an audio output element is disposed within the housing. A control component with a power source is provided for controlling at least one of the visual output element and the audio output element.

18 Claims, 11 Drawing Sheets

(56) References Cited

U.S. PATENT DOCUMENTS

| | | | | |
|---|---|---|---|---|
| 2009/0091925 | A1* | 4/2009 | Hesse | F21L 4/04<br>362/187 |
| 2010/0072895 | A1* | 3/2010 | Glynn | F41H 13/0081<br>315/76 |
| 2010/0285909 | A1* | 11/2010 | Voelker | F41H 13/0087<br>473/570 |
| 2011/0048271 | A1 | 3/2011 | Colon | |
| 2012/0051572 | A1* | 3/2012 | Graber | F41H 5/08<br>381/334 |
| 2012/0247359 | A1 | 10/2012 | Brunn | |

* cited by examiner

TACTICAL DETERRENT DEVICES

CROSS-REFERENCE TO RELATED APPLICATIONS

This application claims priority to and the benefit of U.S. Provisional Patent Application Ser. No. 61/913,783, filed Dec. 9, 2013, and entitled "High Intensity Light and Sound Devices," the disclosure of which is hereby incorporated by reference herein in its entirety.

INTRODUCTION

Flash bang grenades are designed to disorient, and temporarily hinder hostile forces, through the use of light and sound, with the intent of providing an advantage to operatives seeking to gain control of people and/or locations. Current flash bang grenades, while effective in disorienting targets, do not provide a cost effective reusable platform due to the destructive nature of the detonation system, and are by nature rather crude devices which can be dangerous when not handled properly, especially in flammable environments.

SUMMARY

The disclosed devices utilize high powered light-emitting diodes (LED) to severely hinder the sight of, and in some cases temporarily blind, hostile forces. This, in combination with a high output micro-speaker, provide both light and sound as the means of distraction, buying the operator time to gain the upper hand in a variety of scenarios.

The attached figures depict several embodiments of tactical light and sound devices, in accordance with several embodiments of the technology. In certain embodiments, the device uses two high-powered CREE™ XML2-T6 LED light engines, each capable of emitting up to 1040 lumens. These are disposed on either side of a housing, but other locations (as well as numbers of light engines) are contemplated. The device includes an internally-mounted rechargeable power supply, a sealed panel mount activation switch, and an external charging port. In other embodiments, replaceable batteries may be utilized. In addition, the device utilizes a 36 mm diameter micro-speaker, which may be a piezoelectric speaker, contained within the housing. The speaker may produce over 130 decibels at a distance of 1 meter or more, adding to the disorienting effect of the device. In other embodiments, either or both of the lumen and decibel output may exceed the values indicated above.

In one aspect, the technology relates to an apparatus having: a lens; a frame having a gasket for receiving the lens; a shock-resistant housing secured about the frame; a visual output element disposed proximate the lens; an audio output element disposed within the housing; a control component for controlling at least one of the visual output element and the audio output element; and a power source disposed within the housing for providing power to at least one of the visual output element and the audio output element. In an embodiment, the gasket includes a first gasket disposed on a first side of the frame and a second gasket disposed on a second side of the frame opposite the first side, and wherein the lens includes: a first lens disposed in the first gasket; and a second lens disposed in the second gasket. In another embodiment, the housing has a plurality of curved shells. In yet another embodiment, a first of the plurality of curved shells is secured to a second of the plurality of curved shells. In still another embodiment, the plurality of curved shells exerts a compressive force on at least a portion of the first gasket and a portion of the second gasket.

In another embodiment of the above aspect, the lens is resiliently received within the gasket. In an embodiment, the visual element has a light source and wherein the audio output element includes a piezoelectric speaker. In another embodiment, the control component includes at least one of a button, a switch, and a contact. In yet another embodiment, the operation module is operatively connected to the control component and at least one of the visual output element and the audio output element. In still another embodiment, a receiver is operatively connected to the operational module, wherein the receiver is adapted to receive a control signal from a controller disposed external to the housing.

In another aspect, the technology relates to an apparatus having: a frame including a plurality of gaskets; a lens deflectably received within each of the plurality of gaskets; and a hollow housing having a pair of substantially hemispherical sections, wherein each of the pair of substantially hemispherical sections is secured about the frame and proximate each of the plurality of gaskets. In an embodiment, each of the pair of substantially hemispherical sections exerts a compressive force on each of the plurality of gaskets. In another embodiment, the plurality of lenses are substantially aligned along a diameter axis of the apparatus and wherein each of the plurality of lenses is deflectable along the diameter axis. In yet another embodiment, the apparatus further includes: a power source secured to the frame; a visual output element disposed proximate each of the plurality of lenses; an audio output element; an operation module secured to the frame, wherein the operation module is operatively connected to the power source at least one of the visual output element and the audio output element. In still another embodiment, the apparatus further includes a control component for controlling at least one of the visual output element and the audio output element, wherein the control component is operatively connected to the operation module.

In yet another embodiment of the above aspect, the control component includes at least one of a button, a switch, and a contact. In an embodiment, the visual output element has an LED and the audio output element includes a piezoelectric speaker. In another aspect, the technology relates to an apparatus having: a frame; a spherical impact-resistant housing having: a shell component secured to the frame; and a lens component movably secured to the frame; and at least one of a visual output element disposed proximate the lens component and an audio output component; and a control component disposed on an exterior of the housing, wherein the control component controls at least one of the visual output element and the audio output element. In an embodiment, the shell component includes two substantially hemispherical sections and wherein the lens component includes a first spherical cap and a second spherical cap disposed opposite the first spherical cap along a diameter axis. In another embodiment, the first spherical cap and the second spherical cap are movable along the diameter axis.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1:
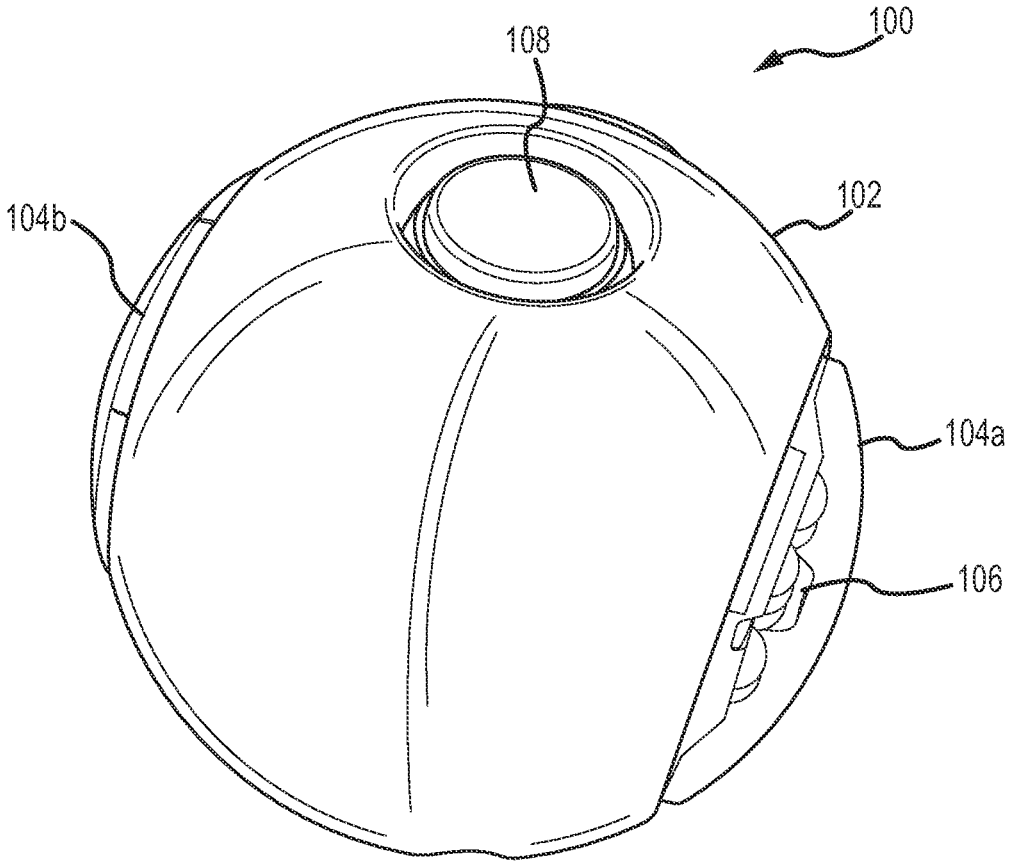
FIG. 1 depicts perspective view of a tactical deterrent device in accordance with one embodiment of the technology.

FIG. 1 depicts perspective view of a tactical deterrent device 100 in accordance with one embodiment of the technology. The device 100 has an outer housing including a shell or base component 102 and one or more lens components 104*a*, 104*b*. The shell component 102 can be formed of two or more portions, as described in more detail below. In the depicted embodiment, the shell component 102 is generally opaque, although other configurations are contemplated. Disposed below each substantially transparent lens component 104*a*, 104*b* is a visual output element 106 such as a light-emitting diode (LED) or other light-emitting element. A control component such as a button 108 is disposed on the shell component 102 and allows an operator or user to control operation of the device 100 (e.g., emission of light via the visual output element 106). Additional components utilized in tactical deterrent devices are described further herein.

Figure 2A:
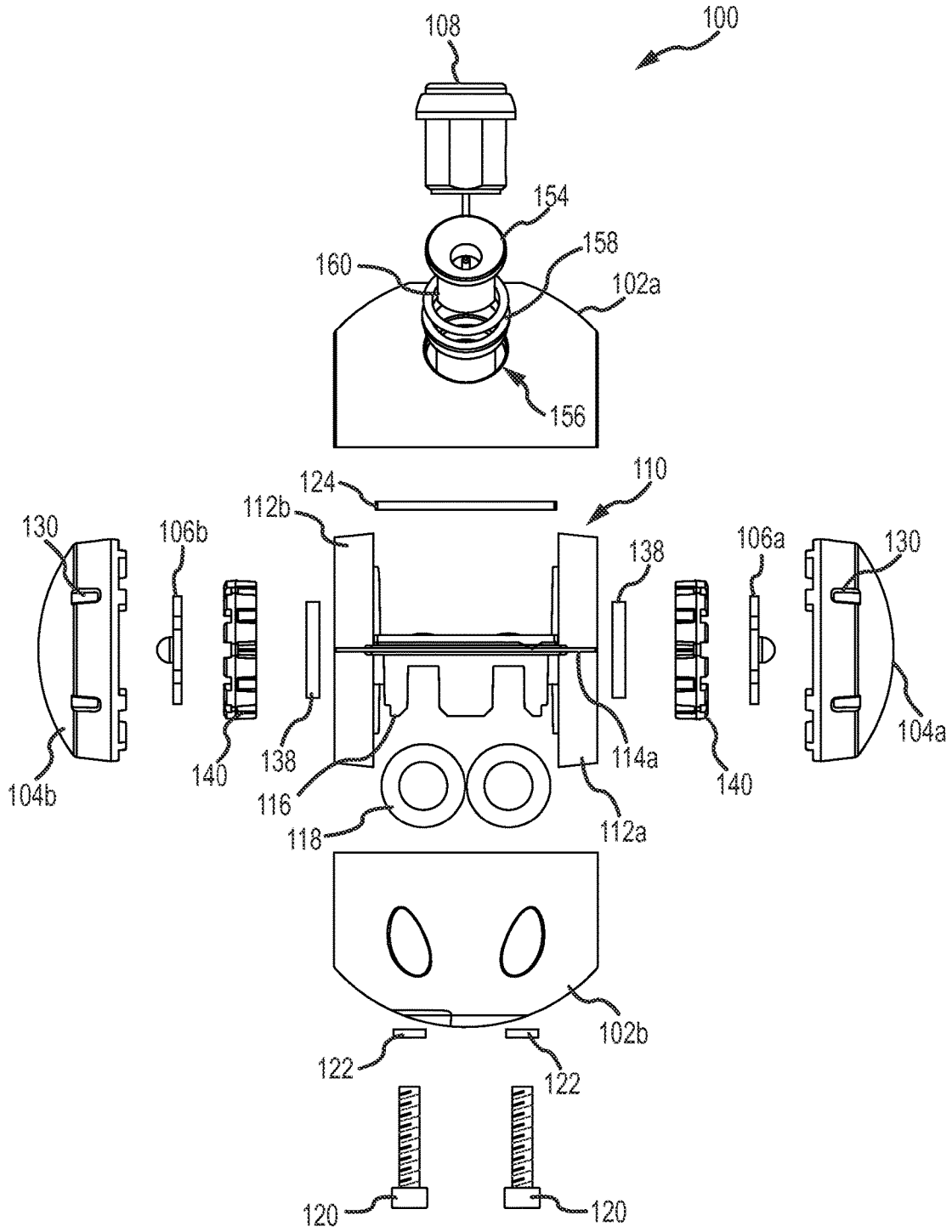
FIG. 2A depicts an exploded front view of the tactical deterrent device of FIG. 1.
Figure 2B:
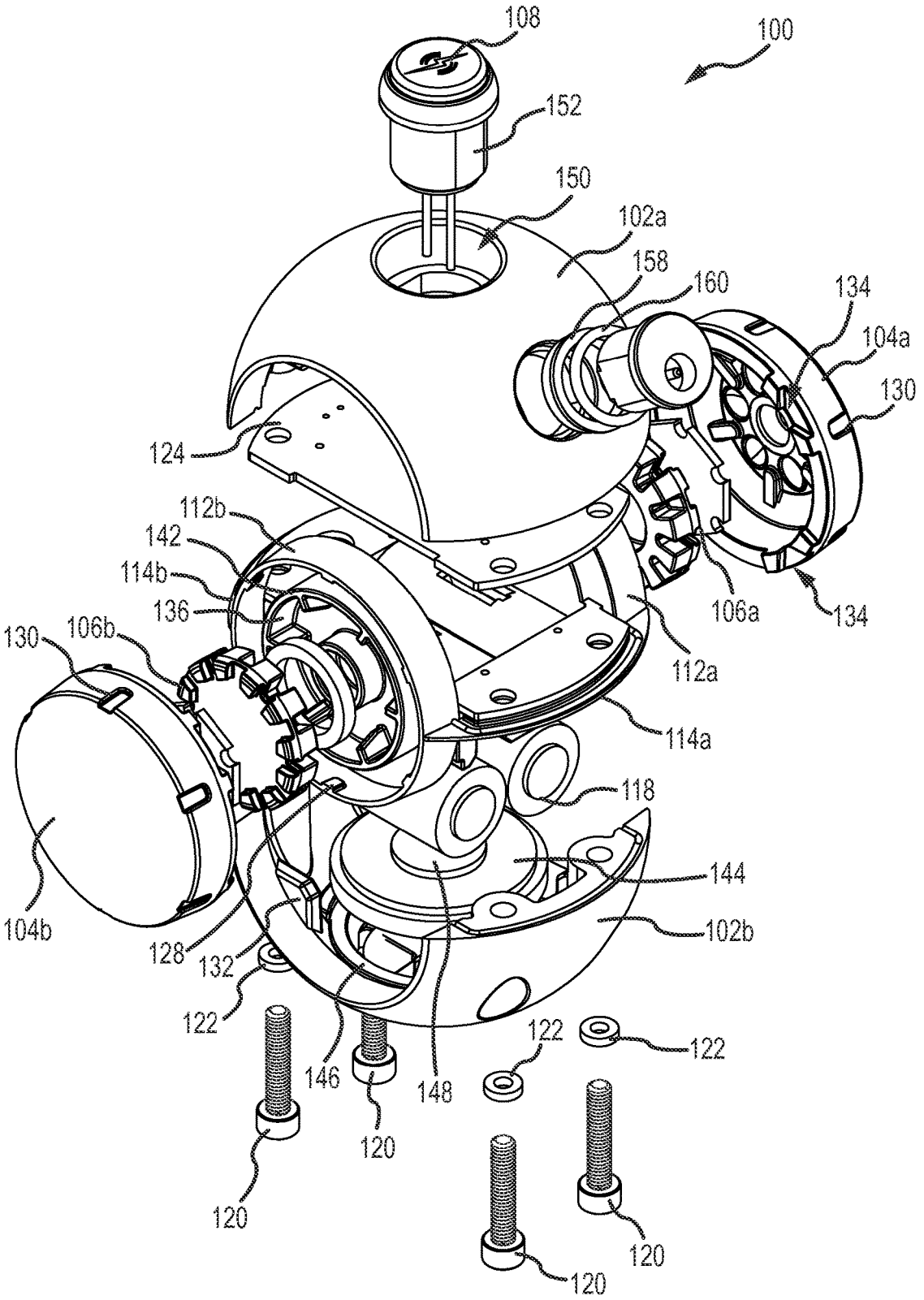
FIG. 2B depicts an exploded perspective view of the tactical deterrent device of FIG. 1.

FIGS. 2A and 2B depict exploded front and perspective views, respectively, of the tactical deterrent device 100 of FIG. 1. A number of components of the device 100 are described above with regard to FIG. 1 and are not necessarily described further. The device 100 is built around a frame 110. The frame 110 includes two lens gaskets 112*a*, 112*b* connected by a plurality of spans 114*a*, 114*b*. The spans 114*a*, 114*b* may form a seal between the two shell portions 102*a*, 102*b* that form a majority of the housing. Additionally, the frame 110 forms a support for a battery holder 116 disposed at a core of the device 100. The battery holder 116 supports a power source which, in this case, is a plurality of batteries 118. A plurality of screws 120 pass through one shell portion 102*b* and into the other shell portion 102*a*. These screws 120 may create compression on the lens gasket 112*a*, 112*b* to form a water-tight seal around each lens 104*a*, 104*b* and between the two shell portions 102*a*, 102*b*. A small gasket 122 is located under the head of each screw 120, between the screws 120 and the shell portion 102*b* in order to create a water-tight seal and prevent backing out of the screws 120. Bolts, chemical adhesives, press fit connections, combinations thereof, or other fastening elements may be utilized.

The shell portions 102*a*, 102*b* of the housing are formed in substantially hemispherical configurations. The shell portions 102*a*, 102*b* press tightly against the battery holder 116. An operation module 124 in the form of a printed circuit board (PCB) may be secured to the battery holder 116. This prevents movement of components within the interior of the device 100. This creates a very rigid platform allowing the device 100 to withstand significant impacts and abuse. Other aspects of the construction aid in maintaining a robust device 100 configuration, allowing the device 100 to be subjected to significant amount of stress due to dropping, throwing, etc., without impacting functionality. These aspects include, but are not limited to, the internal components of the device 100 being held in position through the use of a pressure fit assembly built around a central core foundation (e.g., the frame 110 and the battery holder 116) that requires a limited number of screws 120 to maintain a mechanical connection. Additionally, the lenses 104*a*, 104*b* are in the shape of spherical caps or domes so as to maximize the spread of light across a wide area.

The lens gaskets 112*a*, 112*b* substantially surround each lens 104*a*, 104*b*. A plurality of spans 114*a*, 114*b* connect the lens gaskets 112*a*, 112*b*. This construction mitigates the stress of impact upon the internal components. Each lens gasket 112*a*, 112*b* is aligned with its respective lens 104*a*, 104*b* via keys 128 that align with slots 130 in the lens 104*a*, 104*b*. This mating alignment ensures proper registration of the components, decreases assembly time, and ensures a proper fit. Keys 132 are also disposed on the two shell portions 102*a*, 102*b* to be aligned with a similar number of recessed slots 134 on outer edges of each lens 104*a*, 104*b*. This key 132 and slot 134 arrangement prevents the lenses 104*a*, 104*b* from rotating and helps maintain the structural integrity of the interior components. Additionally, each lens 104*a*, 104*b* may be marked with one or more markings that visually ensure alignment during assembly.

A battery holder 116 is disposed at a core of the device 100 and holds the batteries 118 in place while providing a platform upon which the PCB 124 is mounted. The PCB 124 may be disposed on the battery holder 116 and secured through the use of battery contacts that run through the battery holder 116 and are soldered into position within the PCB 124. Such construction forms a mechanical connection between the battery holder 116 and the PCB 124. The battery holder 116 has circular seats 136 aligned with each lens 104*a*, 104*b*. Each seat 136 supports a heat sink gasket 138, a heat sink 140, the LED board 106*a*, 106*b*, and the lens 104*a*, 104*b*. These elements are stacked such that the lens 104*a*, 104*b* is disposed proximate an outer surface of the device 100. Ribs 142 disposed along the perimeter of each seat 136 align the heat sink 140 and the LED board 106*a*, 106*b*. The net effect is such that, upon assembly, the heat sink gasket 138 is compressed, placing outward pressure on the heat sink 140, LED board 106*a*, 106*b* and lens 104*a*, 104*b* as they make contact with the lens gasket 112*a*, 112*b*.External forces applied against the lenses 104*a*, 104*b* thereby push the LED board 106*a*, 106*b* and heat sink 140 inward towards the core, thus absorbing shock and preventing damage to the device 100, as described in more detail below. Additionally, forces are transferred outward along the perimeter of each lens gasket 112*a*, 112*b* so as to interact with the two shell portions 102*a*, 102*b*. Thus, sufficient pressure is produced to maintain a water-tight seal around each lens gasket 112*a*, 112*b* and create a shock absorption structure that helps protect the PCB 124.

The heat sink gasket 138, heat sink 140, and lens gaskets 112*a*, 112*b* provide shock absorption, reduce vibration, and mitigate the shock of impact to critical internal components. The heat sink 140 is integrated into the device 100 to provide both heat distribution and to form a part of the shock absorption system. The device 100 is designed to prevent internal damage to the battery holder 116 in the event of catastrophic impact through the use of stops (e.g., the key 132 and slot 134) which limit the distance over which the shock absorption system can deflect. This helps prevent the lenses 104*a,* 104*b* from disengaging from their normal operational position. The housing 102 has been designed so as to prevent rotation of the lenses 104*a,* 104*b,* thus helping to maintain the integrity of the LED solder points, even under extreme conditions.

A speaker 144 sits in one of the shell portions 102*b* within a circular platform and maintains its position through the use of a double-sided adhesive gasket 146 which, in turn, creates a water-tight seal between the speaker 144 and the shell portion 102*b.* When the device is assembled, the speaker 144 touches the batteries 118, this creates pressure between the speaker 144 and the batteries 118, thus maintaining the position of the batteries 118 even under extreme conditions. This configuration keeps pressure on the speaker 144, preventing the sealed gasket 146 between the speaker 144 and the shell portion 102*b* from becoming loose or dislodged. The speaker wires are routed from the speaker 144 and pass through an aperture in the battery holder 116 where they are then soldered to the underside of the PCB 124. Sound output from the speaker 144 may be amplified by use of a resonating chamber integrated within the shell portion 102*b.*

The button 118 sits in a recessed aperture 150 within one of the shell portions 102*a* and is held in position through the use of a threaded base 152. A retention nut (not shown) may be secured from the inside of the device 100 that creates a water-tight seal. A charger port 154 likewise sits in a recessed aperture 156 within the shell portion 102*a* with a small gasket 160, screws tight from the back with a nut 158 in order to create a water-tight seal. The wires for the button 118 and charger port 154 are soldered to the PCB 124.

The device 100 is assembled so as to create outward pressure from the battery holder 116 at the core in order to maintain the position of critical components. This construction helps prevent damage to the device 100 during use. It is contemplated that the device 100 may be rolled, dropped, or thrown into a room or other confined space. Materials used may be high-impact plastics and metals, including those that display corrosion resistance. The housing shell portions 102*a,* 102*b,* as well as the lenses 104*a,* 104*b* may also be waterproof. These components may utilize, for example, a seal between shell portions 102*a,* 102*b* and around the openings gaskets 112*a,* 112*b.*

Figure 3:
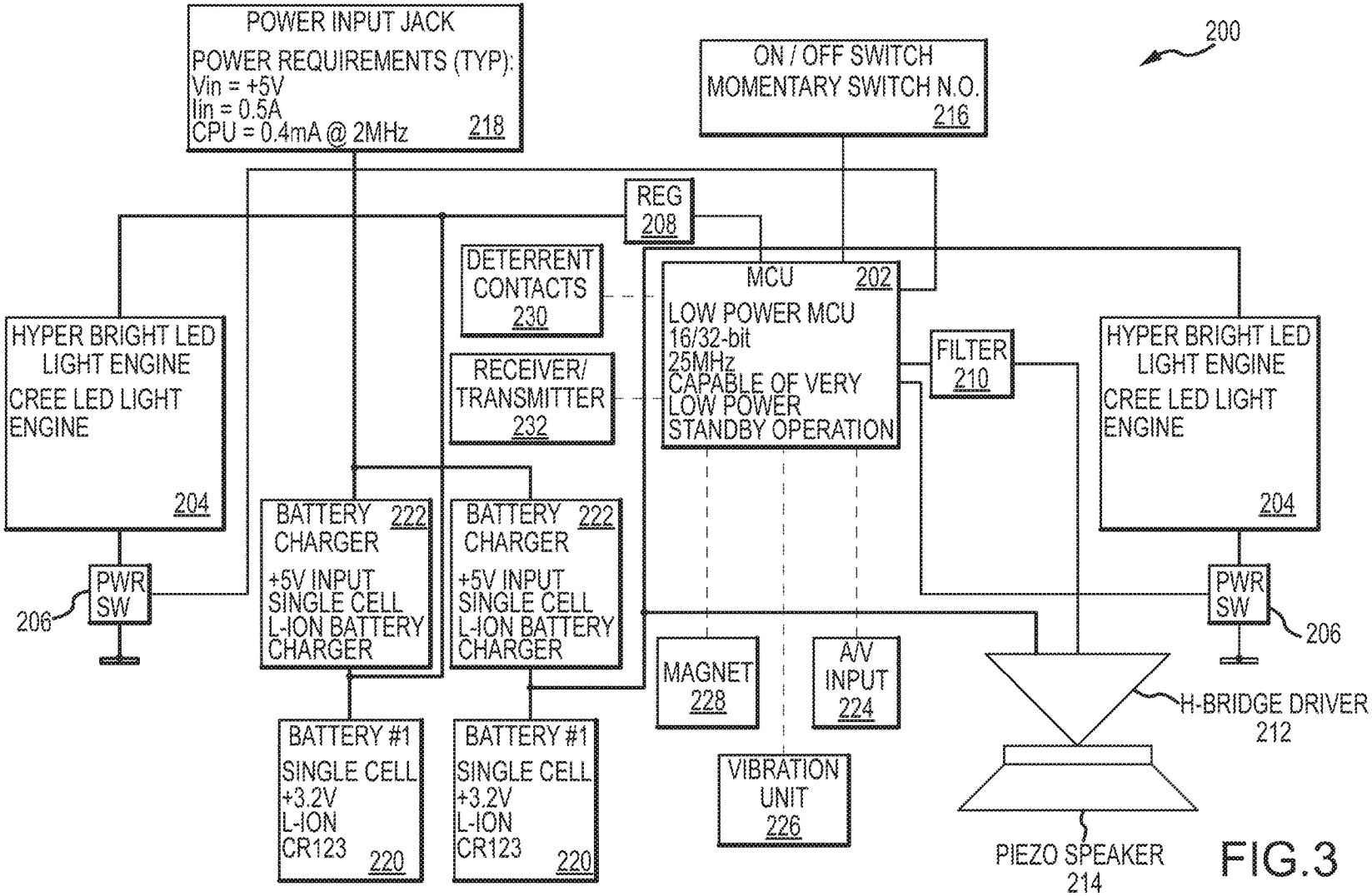
FIG. 3 is a block diagram of a hardware configuration of a tactical deterrent device, in accordance with embodiments of the technology.
Figure 4A:
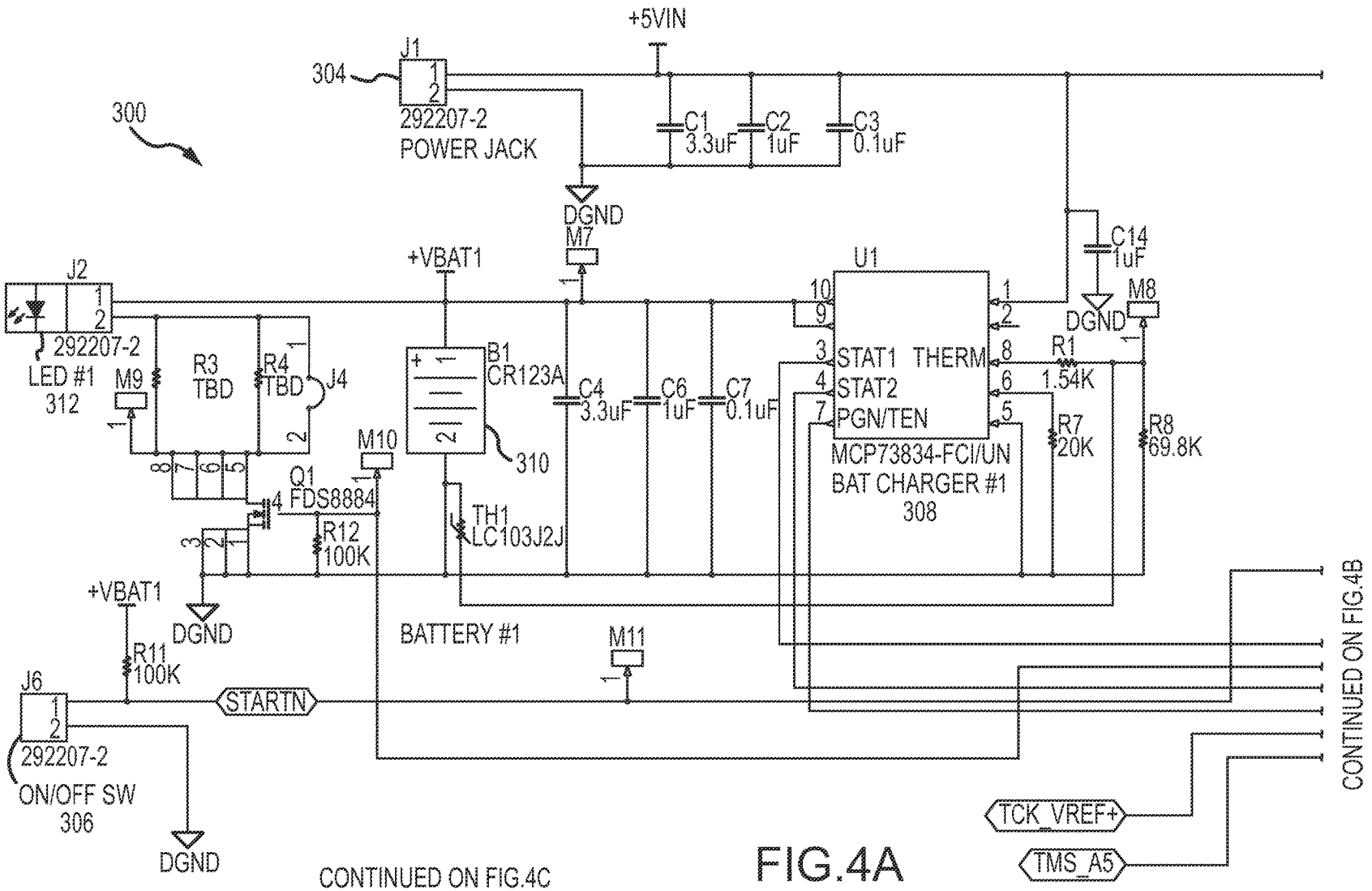
FIGS. 4A-4D is a schematic diagram of a circuit utilized in a tactical deterrent device, in accordance with an embodiment of the technology.
Figure 4B:
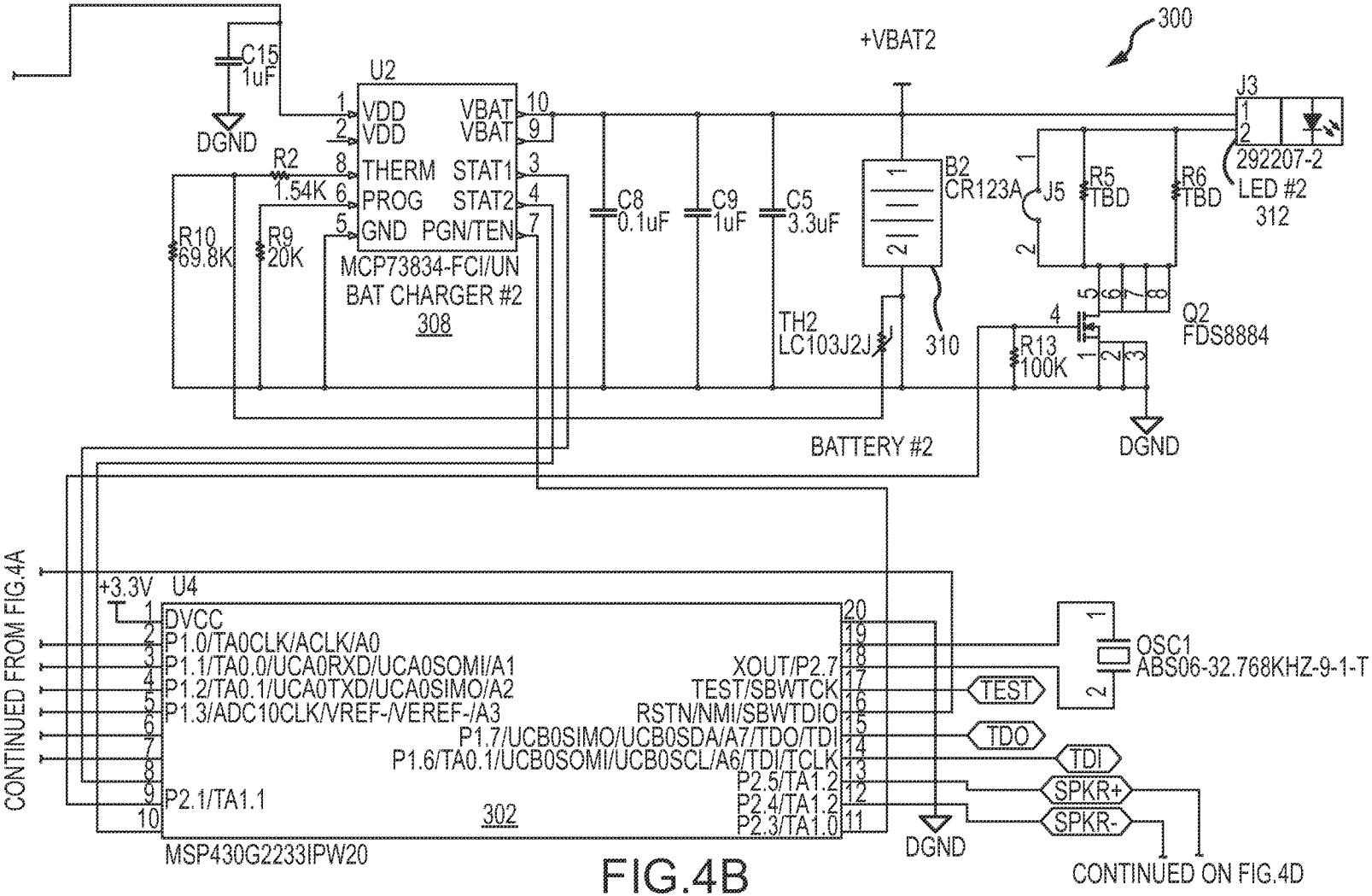
Figure 4C:
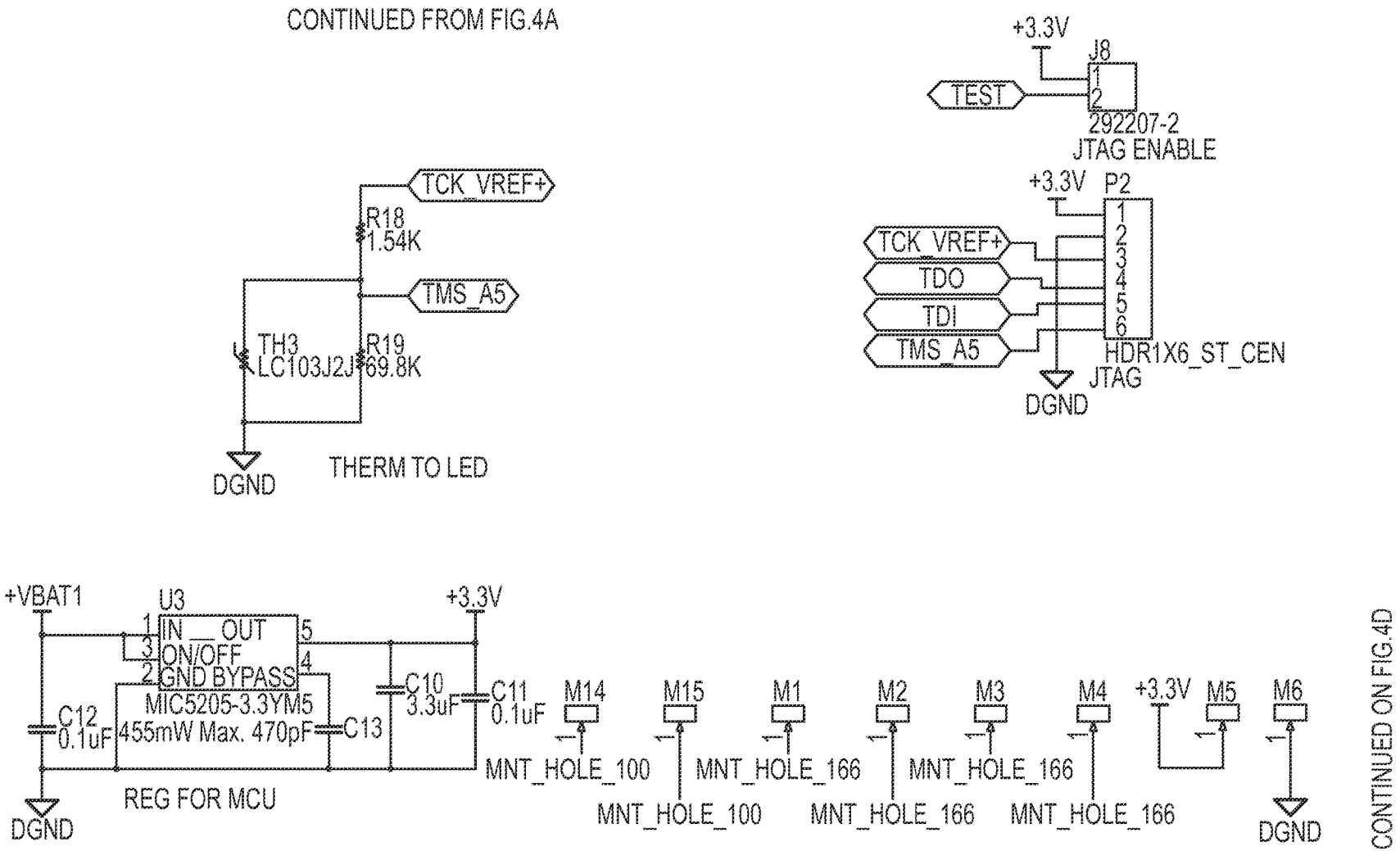
Figure 4D:
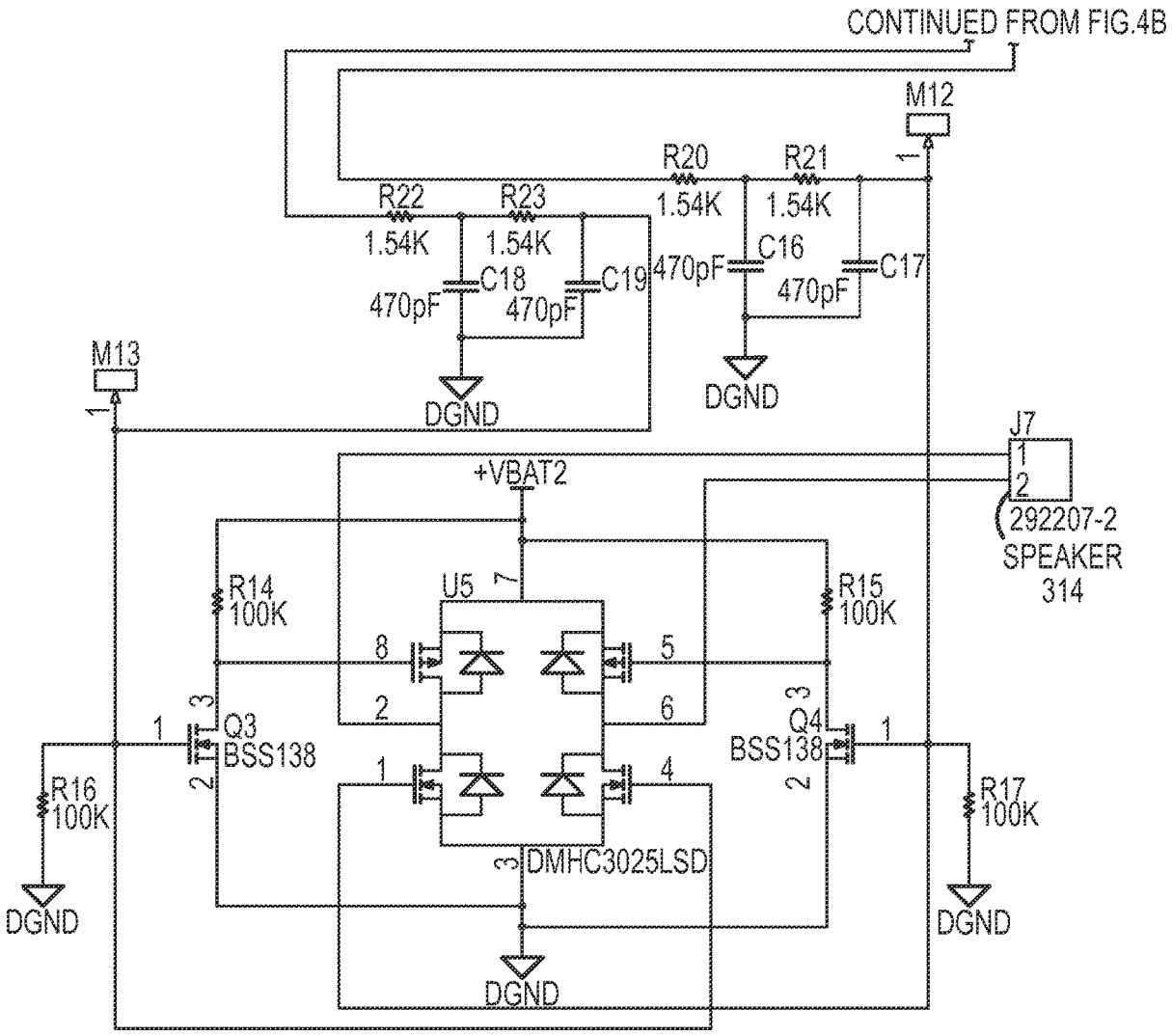

FIG. 3 is a block diagram of a hardware configuration of a tactical deterrent device 200, in accordance with embodiments of the technology. Operation of the device 100 is controlled by a microprocessor 202, which is communicatively connected, either directly or indirectly, to the various components. The microprocessor 202, in one example of a commercial embodiment, may be a 16 or 32-bit, 25 MHz processor that operates with very low power requirements. The microprocessor 202 can include a timer to control operation of the device 200. Two LED light engines 204 are depicted, each driven by a power switch 206, which may control the illumination of the LED associated with each engine 204. The light engines 204 may be CREE LED light engines and drive LEDs that emit a substantially white light or a colored light. Alternatively, one or both of the light engines 204 may drive an infrared LED, which may be advantageous for certain embodiments. A power regulator 208 may be utilized to further regulate the power to or from the light engines 204. A signal filter 210 controls the signal sent from the microprocessor 202 to a speaker driver 212, which drives a speaker 214. In certain embodiments, the speaker 214 may be a piezoelectric speaker. A controller 216, here in the form of an on/off switch, allows a user to operate the device 200 as required or desired. In one embodiment, the controller 216 may be a momentary, normally-off switch. In other embodiments, the controller 216 may be depressed in particular sequences to elicit particular operations from the device 200. Such sequences may allow for individual control of either or both of the LED light engines 204 (e.g., selection of constant or strobe emissions), control of the speaker 214 (e.g., selection of a variety of emitted sounds), and so on. Alternatively, multiple controllers may be utilized to control the various functions of the device 200. A power input jack 218, e.g., in the form of a USB port (e.g., Type A, Type B, Micro, Mini), coaxial DC power port, or other type port, allows for charging of one or more on-board batteries 220. In one embodiment, the power input jack 218 may have the following characteristics: Vin=+5V, Iin=0.5A. Batteries 220 may be lithium ion, 3.7V single-cell batteries (e.g., CR123) or any other type of rechargeable or replaceable batteries known in the art. Corresponding battery chargers 222 can also be utilized if disposable batteries are not desired.

The device 200 may also include other components to increase functionality. For example, the device 200 may include an audio/visual input element 224 (e.g., a microphone or camera), or may connected to a microphone via a hybrid power/data connection (e.g., the power input jack 218 in a USB configuration). The audio/visual input element 224, e.g., a microphone, may be used to record messages that may then be replayed by the device, at high volume or otherwise. The messages may include warnings or instructions, for example "THIS IS THE POLICE," "DROP YOUR WEAPONS," "HELP IS COMING," or other messages. The microphone 224 may also be utilized to listen to the environment in which the device 200 is located, and send those sounds back to a remote device, such as a personal computer at a command station. The device 200 may include an internal gyroscope or vibration element 226. Such a component may be utilized to move or shake the device 200, which may be useful if the device 200 becomes stuck or caught on a structural element located within an environment. Embodiments of the device 200 may include a powerful electromagnet 228 which may be selectively activated to secure the device 200 to a metal building component. Additionally, the device 200 may incorporate one or more deterrent contacts 230 on the outer housing that may emit an electrical discharge if an unauthorized user touches the device 200. In such a case, if a hostile party attempts to lift the device 200 to throw it or disable it, the electrical discharge may compel the party to drop the device 200.

The device 200 may also be used in conjunction with a remote device, such as a laptop or other computer, standalone controller, etc. Communication with the device 200 may be via the power input jack 218 (in the form of a USB connection) and/or a receiver/transmitter 232 that receives and sends wireless signals. The remote device may be used to program the device settings (e.g., audible output volume, output delay time, etc.), activate the output components (e.g., turn the speaker 214 and/or lights 204 on and off), or diagnose the device 200 (e.g., for maintenance and repair purposes). GPS and distress signal elements, capable of alerting the authorities and relaying the position of the device 200 are also contemplated. Thus, the technologies disclosed herein contemplate more simplified devices (e.g., devices that operate based on the position of a switch, with little or no operational variability), and more complex devices (e.g., devices that may be programmed to take certain actions based on certain sensed or programmed conditions). The operating environments of more complex devices are described elsewhere herein.

FIGS. 4A-4D is a schematic diagram of a circuit utilized in a tactical deterrent device 300, in accordance with an embodiment of the technology. The depicted embodiment includes a microprocessor 302, power input jack 304, and on/off switch 306. Two on-board battery chargers 308 are operationally connected to the power input jack 304 to charge two batteries 310. Two LEDs 312 are utilized, as well as one speaker 314. Other components are depicted, but not necessarily described further. Other components, such as those described and depicted herein, may be incorporated into the device 300, as required or desired for a particular application.

Figure 5A:
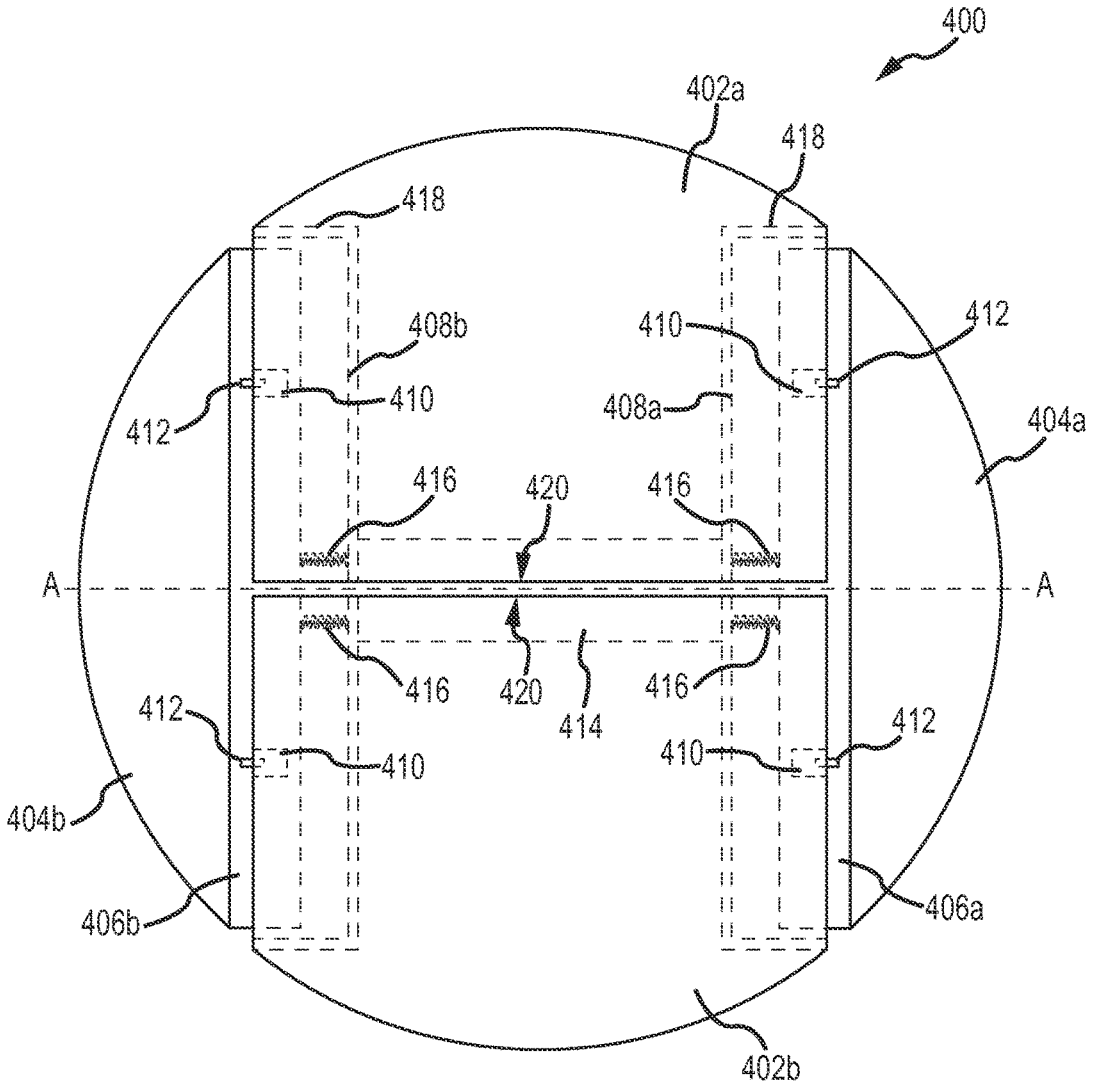
FIGS. 5A and 5B are schematic diagrams depicting forces applied to a tactical deterrent device, in accordance with an embodiment of the technology.
Figure 5B:
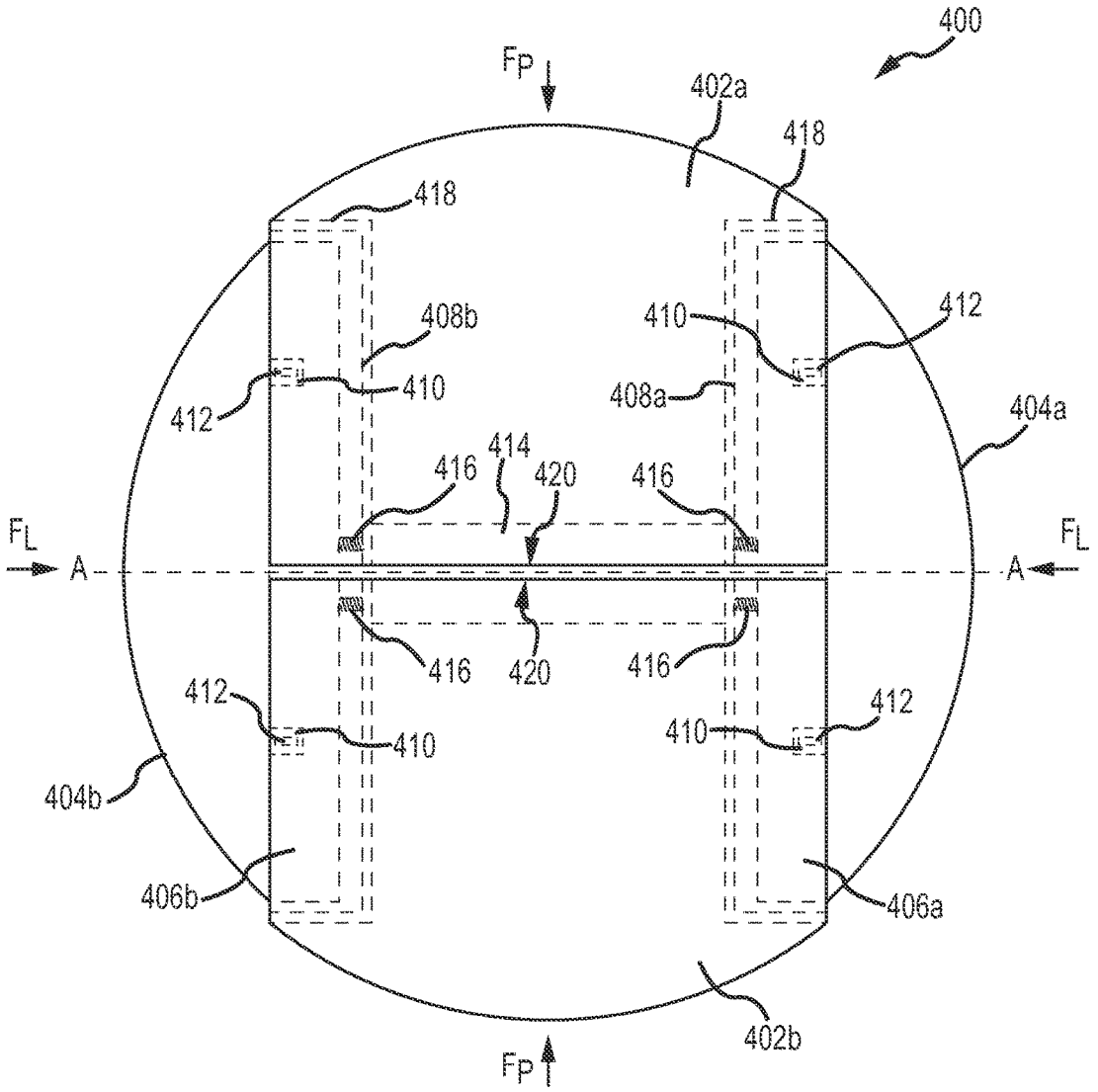

FIGS. 5A and 5B are schematic diagrams depicting forces applied to a tactical deterrent device 400, in accordance with an embodiment of the technology. The device 400 and structures therein are presented in a simplified presentation for clarity. FIG. 5A depicts the device 400 in a neutral state, which may generally be considered a state there are no forces acting against the device 400. The device 400 includes two substantially hemispherical sections 402*a*, 402*b* that form the majority of an area of the outer housing of the device 400. On these sections 402*a*, 402*b* are mounted a controller, power input jack, etc. These components are not shown in this simplified view. Two lenses 404*a*, 404*b* are disposed opposite each other and are substantially aligned with an axis A of the device 400 that extends across a diameter thereof. The lenses 404*a*, 404*b* include base portions 406*a*, 406*b* that extend into the housing sections 402*a*, 402*b*. More specifically, each base portion 406*a*, 406*b* is received by a lens gasket 408*a*, 408*b* that forms an internal frame of the device 400. Edges of each lens gasket 408*a*, 408*b* are depicted in FIGS. 5A and 5B. Each lens gasket 408*a*, 408*b* forms a slot 410 configured to receive a projection, key, or other mating element 412 formed on an exterior of the base portion 406*a*, 406*b*. The lens gaskets 408*a*, 408*b* are separated by a battery holder 414 that forms a central core of the device 400. The lenses 404*a*, 404*b* are biased outward along the diameter axis A by one or more a resilient elements 416 (depicted schematically as compression springs). In one embodiment of the device 400, the resilient elements 416 are the heat sink gaskets 138 depicted in FIG. 2A, but other types of resilient elements may be utilized. Interior edges 418 of the base portions 406*a*, 406*b* are disposed proximate the lens gaskets 408*a*, 408*b*. Additionally, the outer edges 420 of the base portions 406*a*, 406*b* are disposed facing each other.

FIG. 5B depicts the device 400 in a responsive state, which may generally be considered a state where forces $F_L$, $F_P$ are acting on the device 400. Forces $F_L$, $F_P$ are depicted as either substantially parallel or substantially perpendicular to axis A. Of course, forces acting on the device 400 during deployment (due to striking floors or other obstacles) may have multiple vectors neither perpendicular nor parallel to the axis A. The responsive principles of the device 400 acting against forces will still be generally consistent with that described below. Additionally, forces $F_L$, $F_P$ are not necessarily balanced as depicted. For example if the device 400 is dropped on lens 404*a*, force $F_L$ will act mostly on that lens 404*a*. In FIG. 5B, forces $F_L$ act against the lenses 404*a*, 404*b*, and forces $F_P$ act against the base portions 402*a*, 402*b*. With regard to the lenses 404*a*, 404*b*, forces $F_L$ cause a deflection of the lenses 404*a*, 404*b* axially along axis A, towards the core of the device 400 (more specifically, towards the battery holder 414). Alignment during this deflection is ensured by the mating relationship between each slot 410 and its corresponding mating element 412. The resilient elements 416 provide a biasing force against the lenses 404*a*, 404*b* towards the neutral state depicted in FIG. 5A. With regard to the base portions 402*a*, 402*b*, forces $F_P$ cause a temporary deformation of the base portions 402*a*, 402*b*, which may be manufactured from a material such as thermoplastic urethane, which is able to deflect as needed, without significant or any damage thereto. In another embodiment, deflection of the base portions 402*a*, 402*b* may occur. In such an embodiment, the outer edges 420 of the base portions 402*a*, 402*b* may be joined at a resilient element that compresses as the two base portions 402*a*, 402*b* are forced together by force $F_P$. Alternatively or additionally, the gaskets 408*a*, 408*b* may be manufactured of a compressible material which allows compression thereof when the inner edges 418 of the two base portions 402*a*, 402*b* are forced together by force $F_P$. Regardless, after application of the force $F_P$, the material of the base portions 402*a*, 402*b*, or the positions thereof, return to their neutral state.

Materials utilized in the manufacture of the devices described herein include those that are shock- and impact-resistant in a variety of environments. As described above, the base portions may be manufactured of thermoplastic urethane or other high-impact strength plastics, such as TEXIN 270. The lenses may be manufactured of, e.g., clear impact-resistant polycarbonate. Other variations of the device include colored lenses, infrared lighting, and buoyant materials such as might be used in rescue or extraction situations. Internal or external portions of the devices described herein may also be made of titanium, stainless steel, or other materials that display resistance to corrosive environments or substances. Fiber reinforced plastics such as KEVLAR can also be utilized. LEDs utilized in the devices disclosed herein include white-light CREE LEDs having light intensity of about 1040 lumens. Infrared lights of about 990 mW may also be utilized. The devices are intended to be light and hand-deployable.

In certain embodiments, outer device dimensions are about 2.75 inches in diameter. Certain embodiments of the device may weigh 6.5 oz. Other configurations are contemplated.

Figure 6:
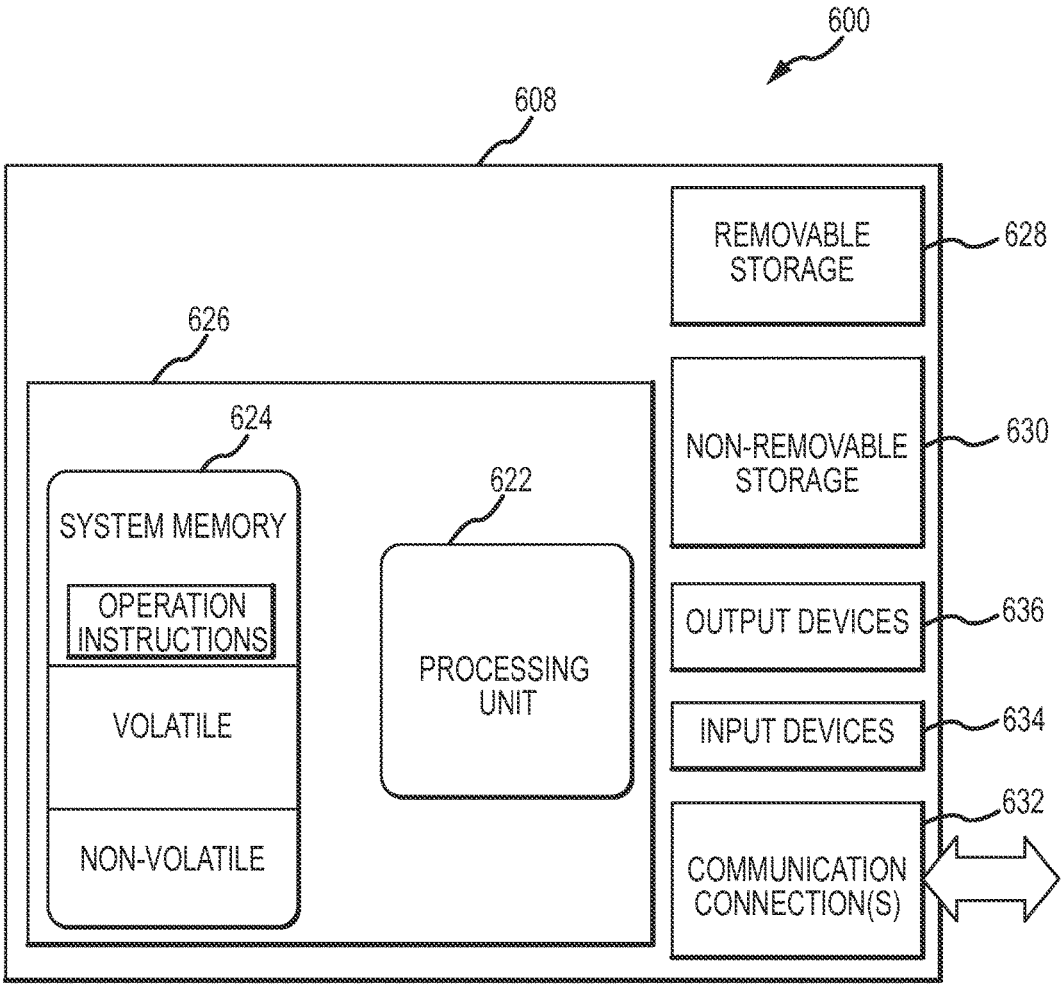
FIG. 6 depicts a block diagram illustrating physical hardware components of a tactical deterrent device in accordance with an embodiment of the technology.

FIG. 6 is a block diagram illustrating physical components (e.g., hardware) of a computing device 600 (e.g., the tactical devices described herein) with which embodiments of the present disclosure may be practiced. Such a computer operating environment 608 is depicted in FIG. 6. This is only one example of a suitable operating environment and is not intended to suggest any limitation as to the scope of use or functionality. Other well-known computing systems, environments, and/or configurations that may be suitable for use include, but are not limited to, personal computers, server computers, hand-held or laptop devices, multiprocessor systems, microprocessor-based systems, programmable consumer electronics such as smart phones, network PCs, minicomputers, mainframe computers, smartphones, tablets, distributed computing environments that include any of the above systems or devices, and the like.

In its most basic configuration, operating environment 608 typically includes at least one processing unit 622 and memory 624. Depending on the exact configuration and type of computing device, memory 624 (storing, among other things, instructions to perform the light and sound emissions, vibrations, etc., described herein) may be volatile (such as RAM), non-volatile (such as ROM, flash memory, etc.), or some combination of the two. This most basic configuration is illustrated in FIG. 6 by line 626. Further, environment 608 may also include storage devices (removable, 628, and/or non-removable, 630) including, but not limited to, magnetic or optical disks or tape. Similarly, environment 608 may also have input device(s) 634 such as touch screens, keyboard, mouse, pen, voice input, etc. and/or output device(s) 636 such as a display, speakers, printer, etc. Also included in the environment may be one or more communication connections, 632, such as LAN, WAN, point to point, Bluetooth, RF, etc.

Operating environment 608 typically includes at least some form of computer readable media. Computer readable media can be any available media that can be accessed by processing unit 622 or other devices comprising the operating environment. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, RAM, ROM, EEPROM, flash memory or other memory technology, CD-ROM, digital versatile disks (DVD) or other optical storage, magnetic cassettes, magnetic tape, magnetic disk storage or other magnetic storage devices, solid state storage, or any other medium which can be used to store the desired information. Communication media embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The operating environment 608 may be a single computer operating in a networked environment using logical connections to one or more remote computers. The remote computer may be a personal computer, a server, a router, a network PC, a peer device or other common network node, and typically includes many or all of the elements described above as well as others not so mentioned. The logical connections may include any method supported by available communications media. Such networking environments are commonplace in offices, enterprise-wide computer networks, intranets and the Internet.

In some embodiments, the components described herein comprise such modules or instructions executable by computer system 608 that may be stored on computer storage medium and other tangible mediums and transmitted in communication media. Computer storage media includes volatile and non-volatile, removable and non-removable media implemented in any method or technology for storage of information such as computer readable instructions, data structures, program modules, or other data. Combinations of any of the above should also be included within the scope of readable media. In some embodiments, computer system 608 is part of a network that stores data in remote storage media for use by the computer system 608.

The embodiments described herein may be employed using software, hardware, or a combination of software and hardware to implement and perform the systems and methods disclosed herein. Although specific devices have been recited throughout the disclosure as performing specific functions, one of skill in the art will appreciate that these devices are provided for illustrative purposes, and other devices may be employed to perform the functionality disclosed herein without departing from the scope of the disclosure.

Numerous programmable operational standards can be implemented in the devices disclosed herein. In one embodiment, once the button is depressed, the speaker emits two or more low decibel clicks, designed to alert the user that the device has been activated and about a 1.5 second delay is then initiated. During the 1.5 second delay the operator deploys the device. After about 1.5 seconds the speaker emits sound (e.g., a siren) at full capacity, running at a frequency of about 3,150 hertz. After about 0.5 to 0.7 seconds of sound, the lights begin to strobe at seven hertz, and this mode of constant sound and intermittent light continues for a period of about five seconds. Once the operational phase is complete, the lights shift from strobe to constant light at about 90% constant power and the speaker disengages. In this way, the room into which the device is located is now partially lit and the operator is free from siren exposure. In order to keep heat levels low, the lights dim to about 70% after about 20 seconds, and to about 50% after about another 20 seconds. The lights then stay on at about 50% until the device is turned off by depressing the button twice within a one second time frame.

In another embodiment, depressing the external controller button arms the device. Once armed, the programmed distracting sequence is activated through the internal processor. Once armed, user feedback is supplied via one or more audible clicks or chirps. This alerts the user that the device is armed and ready to be deployed. In the event that the device has been armed and the user would like to abort further operation, depressing the controller button twice will disable any further operations and reset the device. After the two audible clicks, a no-activity delay begins for a predetermined length of time (e.g., two to four seconds). At this time, the user would normally throw/roll/deploy the device into the intended target environment. The speaker emits a 110 dB siren or other sound at approximately 3 KHz for approximately seven to ten seconds. Simultaneously, LEDs are activated to a maximum light output strobe stage.

Thereafter, the device may be programmed to stop emitting sound and the lighting becomes constant with 80% illumination output. In this mode, the device provides a lighted environment which may aid in a search. The device may reduce light output over time to approximately 50% of maximum. This allows the device to be easily located and retrieved by the user. Thereafter, the device may be deactivated by depressing the controller button twice, in preparation for a subsequent use.

This disclosure described some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. An apparatus comprising:

a frame;

a pair of opposing lens gaskets disposed on opposite ends of the frame;

a lens disposed within each lens gasket;

a heat sink associated with each lens;

a visual output element disposed between each lens and the associated heat sink;

a heat sink gasket associated with each lens, wherein each heat sink gasket biases the associated lens, the associated heat sink, and the associated visual output element away from the frame, wherein each heat sink gasket biases the associated lens into contact with the associated lens gasket;

a shock-resistant housing secured about the frame;

an audio output element disposed within the housing;

a control component for controlling at least one of the visual output element and the audio output element; and a power source disposed within the housing for providing power to at least one of the visual output element and the audio output element.

2. The apparatus of claim 1, wherein the pair of opposing lens gaskets comprises a first lens gasket secured to a first end of the frame and a second lens gasket secured to a second end of the frame.

3. The apparatus of claim 1, wherein the housing comprises a plurality of curved shells.

4. The apparatus of claim 3, wherein a first of the plurality of curved shells is secured to a second of the plurality of curved shells.

5. The apparatus of claim 4, wherein the plurality of curved shells exerts a compressive force on at least a portion of the first lens gasket and a portion of the second lens gasket.

6. The apparatus of claim 1, wherein each lens is received within the associated lens gasket.

7. The apparatus of claim 1, wherein the visual output element comprises a light source and wherein the audio output element comprises a piezoelectric speaker.

8. The apparatus of claim 1, wherein the control component comprises at least one of a button, a switch, and a contact.

9. The apparatus of claim 1, further comprising an operation module, wherein the operation module is operatively connected to the control component and at least one of the visual output element and the audio output element.

10. The apparatus of claim 9, further comprising a receiver operatively connected to the operational module, wherein the receiver is adapted to receive a control signal from a controller disposed external to the housing.

11. An apparatus comprising:

a frame comprising a plurality of lens gaskets disposed on opposite ends of the frame along a diameter axis of the apparatus;

a pair of opposed lenses received within each of the plurality of lens gaskets, wherein the pair of opposed lenses are substantially aligned along the diameter axis of the apparatus and wherein each of the pair of opposed lenses is movable along the diameter axis towards and away from each other; and a hollow housing comprising a pair of substantially hemispherical sections, wherein each of the pair of substantially hemispherical sections is secured about the frame and proximate each of the plurality of lens gaskets, wherein the hollow housing contains:

a power source secured to the frame;

a visual output element disposed proximate each of the pair of opposed lenses;

an audio output element; and an operation module secured to the frame, wherein the operation module is operatively connected to the power source and at least one of the visual output element and the audio output element.

12. The apparatus of claim 11, wherein each of the pair of substantially hemispherical sections exerts a compressive force on each of the plurality of lens gaskets.

13. The apparatus of claim 11, further comprising a control component for controlling at least one of the visual output element and the audio output element, wherein the control component is operatively connected to the operation module.

14. The apparatus of claim 13, wherein the control component comprises at least one of a button, a switch, and a contact.

15. The apparatus of claim 11, wherein the visual output element comprises an LED and the audio output element comprises a piezoelectric speaker.

16. An apparatus comprising:

a frame comprising a lens gasket disposed at an end of the frame, and wherein the lens gasket comprises a plurality of keys extending therefrom;

a spherical impact-resistant housing defining an interior, wherein the housing comprises a shell component secured to the frame;

a lens component, a visual output element, and a heat sink movably secured to the frame, wherein a force acting on the lens component moves the lens component, the visual output element, and the heat sink towards the interior, and wherein the lens component defines a plurality of slots for mating engagement with the plurality of keys;

an audio output component within the interior;

a heat sink gasket for biasing the lens component and the visual output element in a direction opposite the force; and a control component disposed on an exterior of the housing, wherein the control component controls at least one of the visual output element and the audio output element.

17. The apparatus of claim 16, wherein the shell component comprises two substantially hemispherical sections and wherein the lens component comprises a first spherical cap and a second spherical cap disposed opposite the first spherical cap along a diameter axis.

18. The apparatus of claim 17, wherein the first spherical cap and the second spherical cap are movable along the diameter axis.

* * * * *